US012663175B2

(12) United States Patent
Okeda et al.

(10) Patent No.: US 12,663,175 B2
(45) Date of Patent: Jun. 23, 2026

(54) AIR CONDITIONER

(71) Applicant: FUJITSU GENERAL LIMITED, Kanagawa (JP)

(72) Inventors: Junpei Okeda, Kanagawa (JP); Hiroaki Takahashi, Kanagawa (JP); Kaoru Kokuta, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 138 days.

(21) Appl. No.: 18/682,128

(22) PCT Filed: Jul. 25, 2022

(86) PCT No.: PCT/JP2022/028559
§ 371 (c)(1),
(2) Date: Feb. 8, 2024

(87) PCT Pub. No.: WO2023/062909
PCT Pub. Date: Apr. 20, 2023

(65) Prior Publication Data

US 2024/0377095 A1 Nov. 14, 2024

(30) Foreign Application Priority Data

Oct. 15, 2021 (JP) ..... 2021-169367

(51) Int. Cl.
*F24F 11/871* (2018.01)
*F24F 11/65* (2018.01)
*F24F 13/20* (2006.01)

(52) U.S. Cl.
CPC ..... *F24F 11/871* (2018.01); *F24F 11/65* (2018.01); *F24F 13/20* (2013.01)

(58) Field of Classification Search
CPC ..... F24F 11/871; F24F 11/65; F24F 13/20; F24F 1/52; F24F 11/77; Y02B 30/70
See application file for complete search history.

(56) References Cited

U.S. PATENT DOCUMENTS

2023/0114621 A1 4/2023 Aoki et al.

FOREIGN PATENT DOCUMENTS

| | | | | | |
|---|---|---|---|---|---|
| CN | 1482408 | A | * | 3/2004 | ..... F24F 11/77 |
| CN | 107101320 | A | * | 8/2017 | ..... F24F 2110/10 |
| EP | 1813888 | A2 | | 8/2007 | |
| JP | H06-221649 | A | | 8/1994 | |
| JP | H08-271067 | A | | 10/1996 | |
| JP | 2001-272087 | A | | 10/2001 | |
| JP | 2002-340367 | A | | 11/2002 | |
| JP | 2007-247947 | A | | 9/2007 | |

(Continued)

*Primary Examiner* — Kun Kai Ma
(74) *Attorney, Agent, or Firm* — Paratus Law Group, PLLC

(57) ABSTRACT

An air conditioner according to an embodiment of the present invention includes: a refrigerant circuit including a compressor, an outdoor heat exchanger, an indoor heat exchanger, and a pressure reducer that is disposed between the outdoor heat exchanger and the indoor heat exchanger; an outdoor fan that blows the air to the outdoor heat exchanger; an indoor fan that blows the air to the indoor heat exchanger; and a control device that sets an upper limit value of a rotational frequency of the outdoor fan in accordance with a rotational frequency of the indoor fan.

5 Claims, 6 Drawing Sheets

(56) References Cited

FOREIGN PATENT DOCUMENTS

| | | | | |
|---|---|---|---|---|
| JP | 2018063091 | A | * | 4/2018 |
| JP | 2019-178811 | A | | 10/2019 |
| WO | WO 2021/187440 | A1 | | 9/2021 |

* cited by examiner

| Operation mode | | Upper limit value of rotational frequency of outdoor fan | | | | |
|---|---|---|---|---|---|---|
| | | Hi | Me | Lo | Qu | Auto |
| Cooling/drying | | 1450rpm | 1210rpm | 1110rpm | 1010rpm | 1450rpm |
| Heating | State 1 | 1450rpm | 1210rpm | | | 1450rpm |
| | State 2 | 1360rpm | 1210rpm | 1110rpm | 1010rpm | 1360rpm |

AIR CONDITIONER

CROSS REFERENCE TO PRIOR APPLICATION

This application is a National Stage Patent Application of PCT International Patent Application No. PCT/JP2022/028559 (filed on Jul. 25, 2022) under 35 U.S.C. § 371, which claims priority to Japanese Patent Application No. 2021-169367 (filed on Oct. 15, 2021), which are all hereby incorporated by reference in their entirety.

TECHNICAL FIELD

The present invention relates to an air conditioner.

BACKGROUND ART

In a heat pump type air conditioner, a refrigerant circulates in the order of a compressor, an outdoor heat exchanger, a pressure reducer, and an indoor heat exchanger for example during a cooling operation. At this time, the refrigerant that has flowed in the outdoor heat exchanger from the compressor is condensed by heat exchange with outdoor air blown by the outdoor fan and flows to the indoor heat exchanger via the pressure reducer. The refrigerant that has flowed in the indoor heat exchanger is evaporated by heat exchange with indoor air blown by the indoor fan and is sucked by the compressor.

For example, during the cooling operation, the indoor fan adjusts the amount of heat absorption of a refrigerant in the indoor heat exchanger and blows air cooled by heat exchange with the refrigerant flowing through the indoor heat exchanger to the inside. Meanwhile, the outdoor fan adjusts the amount of heat dissipation of the refrigerant in the outdoor heat exchanger by controlling a rotational frequency according to an outside air temperature. For example, Patent Literature 1 has disclosed an air conditioner configured to control a rotational frequency of an outdoor fan on the basis of an outdoor air temperature and a temperature of a refrigerant in an outdoor heat exchanger or a temperature of blown air in the outdoor heat exchanger.

CITATION LIST

Patent Literature

Patent Literature 1: Japanese Patent Application Laid open No. HEI 6 221649

Patent Literature 2: Japanese Patent Application Laid open No. 2002 340367

DISCLOSURE OF INVENTION

Technical Problem

During the operation of the outdoor fan, operational noise such as wind noise is typically generated. With an air conditioner in which a heat source side unit is located outside the room and a use side unit is located inside the room, sandwiching an outer wall of a building, a user located in the room rarely notices operational noise of the outdoor fan.

However, in the case where the outdoor environment is more silent than that in the daytime for example during a midnight operation, the user located in the room sometimes notices operational noise of the outdoor fan. Moreover, with an air conditioner (e.g., see Patent Literature 2) in which operational noise of some of configurations that performs functions of a heat source side unit including at least a heat source side blower easily reaches the user located in the room, operational noise of the heat source blower is sometimes louder than operational noise of the use side blower. Therefore, with such an air conditioner, the user located in the room is likely to notice operational noise of the outdoor fan.

Therefore, with the air conditioner including the outdoor fan that rotates at a rotational frequency determined in accordance with the outdoor air temperature, the temperature of the refrigerant in the outdoor heat exchanger, and the like for example as described in Patent Literature 1, the user located in the room tends to consider operational noise of the outdoor fan as loud noise for example during a high load operation. Therefore, the user located in the room may feel that it is unpleasant to the ears, for example. Thus, comfort and usability may be impaired.

In view of the above mentioned circumstances, it is an objective of the present invention to provide an air conditioner capable of preventing deterioration of the usability due to operational noise of the outdoor fan.

Solution to Problem

An air conditioner according to an embodiment of the present invention includes a compressor, an outdoor heat exchanger, an indoor heat exchanger, and a pressure reducer that is disposed between the outdoor heat exchanger and the indoor heat exchanger;

- an outdoor fan that blows the air to the outdoor heat exchanger;
- an indoor fan that blows the air to the indoor heat exchanger; and
- a control device that sets an upper limit value of a rotational frequency of the outdoor fan in accordance with a rotational frequency of the indoor fan.

The air conditioner may further include an external casing fitted in an opening of a building wall that partitions an indoor space and an outdoor space, in which the outdoor heat exchanger and the outdoor fan may be disposed in the external casing.

The control device may reduce, when the rotational frequency of the indoor fan decreases, the rotational frequency of the outdoor fan in accordance with a rate of decrease in the rotational frequency of the indoor fan.

The control device may change, when a rotational frequency of the compressor changes from a first rotational frequency into a second rotational frequency lower than the first rotational frequency, the upper limit value of the rotational frequency of the outdoor fan from a first upper limit value into a second upper limit value lower than the first upper limit value.

The air conditioner may have a plurality of operation modes depending on a set airflow rate of the indoor fan, the control device may set the upper limit value of the rotational frequency of the outdoor fan in accordance with the plurality of operation modes, and the set upper limit value of the rotational frequency of the outdoor fan may be equal to or lower than an upper limit value of the rotational frequency of the outdoor fan on an operation mode on which the airflow rate is higher by at least one level.

Advantageous Effects of Invention

In accordance with the present invention, it is possible to prevent deterioration of the usability due to operational noise of the outdoor fan.

MODE(S) FOR CARRYING OUT THE INVENTION

Hereinafter, embodiments of the present invention will be described with reference to the drawings.

Figure 1:
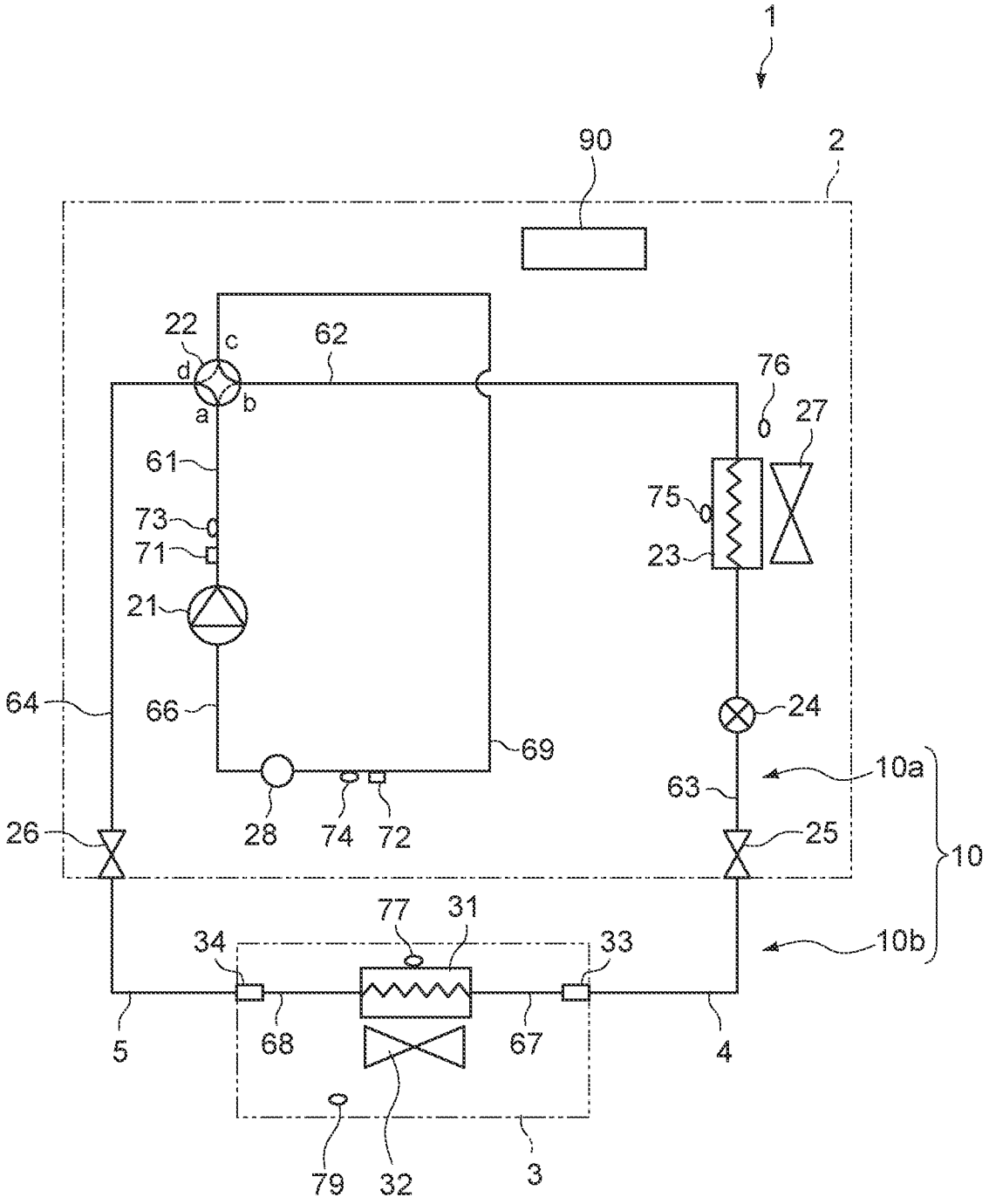
FIG. 1 A refrigerant circuit diagram of an air conditioner according to an embodiment of the present invention.

FIG. 1 is a refrigerant circuit diagram of an air conditioner according to an embodiment of the present invention. An air conditioner 1 according to the present embodiment includes an outdoor unit 2 and an indoor unit 3 connected to the outdoor unit 2 through a liquid pipe 4 and a gas pipe 5. Specifically, a stop valve 25 of the outdoor unit 2 and a liquid pipe connection portion 33 of the indoor unit 3 are connected to each other through the liquid pipe 4. Moreover, a stop valve 26 of the outdoor unit 2 and a gas pipe connection portion 34 of the indoor unit 3 are connected to each other through the gas pipe 5. In such a manner, a refrigerant circuit 10 of the air conditioner 1 is formed.

[Configuration of Outdoor Unit]

The outdoor unit 2 includes a compressor 21, a four way valve 22, an outdoor heat exchanger 23, an expansion valve 24 as a pressure reducer, the stop valve 25 to which one end of the liquid pipe 4 has been connected, the stop valve 26 to which one end of the gas pipe 5 has been connected, an outdoor fan 27, and an accumulator 28. These devices excluding the outdoor fan 27 are connected to each other through each refrigerant pipe to be described later, thereby forming an outdoor unit refrigerant circuit 10*a* that forms a part of the refrigerant circuit 10.

The compressor 21 is a variable displacement compressor that includes a variable rotational frequency motor (not shown) and changes the operation capacity by an inverter (not shown) controlling the rotational frequency of the motor to vary. A refrigerant discharge port of the compressor 21 is connected to a port a of the four way valve 22 through a discharge pipe 61. Moreover, a refrigerant suction port of the compressor 21 is connected to a refrigerant flow out port of the accumulator 28 through a suction pipe 66.

The four way valve 22 is a flow channel switching unit for switching a direction in which a refrigerant flows in the refrigerant circuit 10. Specifically, the four way valve 22 switches the refrigerant circuit 10 to either one of a cooling refrigerant circuit that circulates the refrigerant discharged from the compressor 21 in the order of the outdoor heat exchanger 23, the expansion valve 24, an indoor heat exchanger 31, and the accumulator 28 and a heating refrigerant circuit that circulates the refrigerant discharged from the compressor 21 in the order of the indoor heat exchanger 31, the expansion valve 24, the outdoor heat exchanger 23, and the accumulator 28.

The four way valve 22 includes four ports a, b, c, and d. As described above, the port a is connected to the refrigerant discharge port of the compressor 21 through the discharge pipe 61. The port b is connected to one refrigerant outlet/inlet of the outdoor heat exchanger 23 through a refrigerant pipe 62. The port c is connected to a refrigerant flow in port of the accumulator 28 through a refrigerant pipe 69. The port d is connected to the stop valve 26 through an outdoor unit gas pipe 64.

The outdoor heat exchanger 23 exchanges heat of the outside air taken in the outdoor unit 2 with the refrigerant by rotation of the outdoor fan 27. As described above, one refrigerant outlet/inlet of the outdoor heat exchanger 23 is connected to the port b of the four way valve 22 through the refrigerant pipe 62 and the other refrigerant outlet/inlet is connected to an outdoor unit liquid pipe 63 through the stop valve 25. The outdoor heat exchanger 23 functions as a condenser during a cooling operation and functions as an evaporator during a heating operation by switching of the four way valve 22 to be described later.

The expansion valve 24 is an electronic expansion valve driven by a pulse motor (not shown). The expansion valve 24 is provided in the outdoor unit liquid pipe 63. Specifically, the degree of opening of the expansion valve 24 is adjusted to a degree of opening between full close and full open in accordance with the number of pulses added to the pulse motor. The degree of opening of the expansion valve 24 is adjusted depending on heating capability required by the indoor unit 3 during the heating operation and is adjusted depending on cooling capability required by the indoor unit 3 during the cooling operation.

The outdoor fan 27 is made of a resin material. The outdoor fan 27 is disposed in vicinity of the outdoor heat exchanger 23. Rotated by a fan motor (not shown), the outdoor fan 27 takes outdoor air (outside air) into the outdoor unit 2 through an air inlet (not shown) of the outdoor unit 2 and discharges the outside air whose heat has been exchanged with the refrigerant in the outdoor heat exchanger 23 to the outside of the outdoor unit 2 through an air outlet (not shown) of the outdoor unit 2.

The accumulator 28 separates the refrigerant that has flowed in it into a gas refrigerant and a liquid refrigerant. Then, the compressor 21 sucks only the gas refrigerant through the suction pipe 66. The refrigerant flow in port of the accumulator 28 and the port c of the four way valve 22 are connected to each other through the refrigerant pipe 69. The refrigerant flow out port of the accumulator 28 and the refrigerant suction port of the compressor 21 are connected to each other through the suction pipe 66.

In addition to the configurations described above, the outdoor unit 2 is provided with various sensors. In the present embodiment, as shown in FIG. 1, the discharge pipe 61 is provided with a discharge pressure sensor 71 that detects a discharge pressure which is a pressure of the refrigerant discharged from the compressor 21 and a discharge temperature sensor 73 that detects a discharge temperature which is a temperature of the refrigerant discharged from the compressor 21. The refrigerant pipe 69 is provided with a suction pressure sensor 72 that detects a suction pressure which is a pressure of the refrigerant at which it is sucked by the compressor 21 and a suction temperature sensor 74 that detects a suction temperature which is a temperature of the refrigerant sucked by the compressor 21.

The outdoor heat exchanger 23 is provided with an outdoor heat exchange temperature sensor 75 that detects an outdoor heat exchange temperature which is a temperature of the outdoor heat exchanger 23. An outside air temperature sensor 76 that detects a temperature of the outside air flowing in the casing (not shown) of the outdoor unit 2, i.e., an outside air temperature is provided near the air inlet (not shown) of the outdoor unit 2.

[Configuration of Indoor Unit]

Next, the indoor unit 3 will be described with reference to FIG. 1. The indoor unit 3 includes the indoor heat exchanger 31, an indoor fan 32, the liquid pipe connection portion 33 to which the other end of the liquid pipe 4 has been connected, and a gas pipe connection portion 34 to which the other end of the gas pipe 5 has been connected. These devices excluding the indoor fan 32 are connected to each other through each refrigerant pipe to be described later in detail, thereby forming an indoor unit refrigerant circuit 10*b* that forms a part of the refrigerant circuit 10.

The indoor heat exchanger 31 exchanges heat of indoor air taken in the indoor unit 3 through an air inlet (not shown) of the indoor unit 3 with the refrigerant by rotation of the indoor fan 32. One refrigerant outlet/inlet of the indoor heat exchanger 31 is connected to the liquid pipe connection portion 33 through an indoor unit liquid pipe 67. The other refrigerant outlet/inlet of the indoor heat exchanger 31 is connected to the gas pipe connection portion 34 through an indoor unit gas pipe 68. The indoor heat exchanger 31 functions as an evaporator in the case where the indoor unit 3 performs the cooling operation and functions as a condenser in the case where the indoor unit 3 performs the heating operation. It should be noted that in the liquid pipe connection portion 33 and the gas pipe connection portion 34, the refrigerant pipes are connected by welding, flare nuts, etc.

The indoor fan 32 is made of a resin material. The indoor fan 32 is disposed in vicinity of the indoor heat exchanger 31. Rotated by a fan motor (not shown), the indoor fan 32 takes the indoor air into the indoor unit 3 through the air inlet (not shown) of the indoor unit 3 and blows out the indoor air whose heat has been exchanged with the refrigerant in the indoor heat exchanger 31 to the inside through an air outlet (not shown) of the indoor unit 3.

In addition to the configurations described above, the indoor unit 3 is provided with various sensors. In the present embodiment, as shown in FIG. 1, the indoor unit liquid pipe 67 is provided with an indoor heat exchange temperature sensor 77 that detects an indoor heat exchange temperature which is a temperature of the indoor heat exchanger 31. A room temperature sensor 79 that detects a temperature of the indoor air flowing in the indoor unit 3, i.e., a room temperature is provided near the air inlet (not shown) of the indoor unit 3.

[Control Device]

The air conditioner 1 includes a control device 90. The control device 90 is, for example, an outdoor unit control device provided in the outdoor unit 2. The control device 90 is mounted on a control board stored in an electric box (not shown) of the outdoor unit 2.

Figure 2:
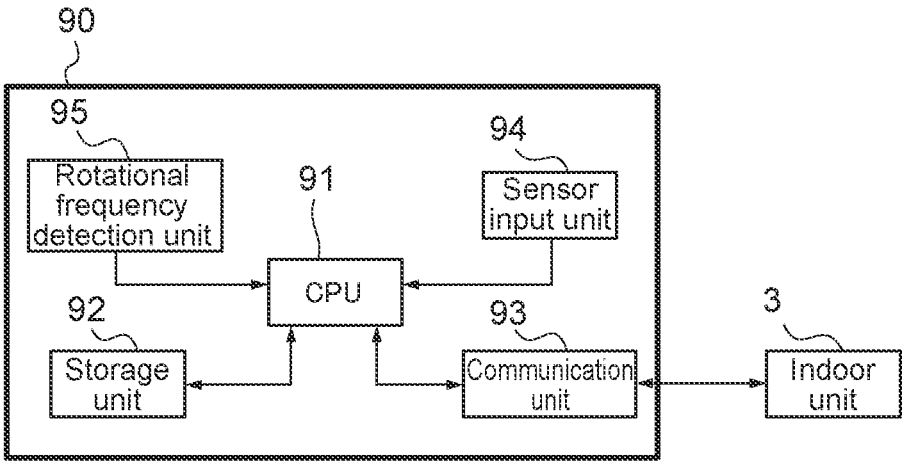
FIG. 2 A block diagram showing configurations of a control device in the air conditioner.

FIG. 2 is a block diagram showing configurations of the control device 90. As shown in the figure, the control device 90 includes a CPU 91, a storage unit 92, a communication unit 93, a sensor input unit 94, and a rotational frequency detection unit 95.

The storage unit 92 is a nonvolatile memory such as a flash memory. The storage unit 92 stores control programs and control parameters of the outdoor unit 2, control programs and control parameters corresponding to detected signals from the various sensors, control states of the compressor 21, the outdoor fan 27, and the like, a control state of the indoor unit 3 including the rotational frequency and the like of the indoor fan 32 acquired via the communication unit 93, an operation mode set and input by the user, and so on.

The communication unit 93 is an interface for communicating with the indoor unit 3. The sensor input unit 94 receives detection results from the various sensors of the outdoor unit 2 and outputs them to the CPU 91. The rotational frequency detection unit 95 detects rotational frequency of the motor of the compressor 21 and outputs it to the CPU 91. The rotational frequency detection unit 95 may be configured to directly detect the rotational frequency of the motor by an encoder or the like attached to a drive shaft of the motor or may be configured to detect the rotational frequency of the motor from a driving current supplied to the motor. In the following description, the rotational frequency of the compressor 21 refers to the rotational frequency of the motor.

The CPU 91 is a control unit that controls operations of the respective parts of the outdoor unit 2 including the compressor 21 by executing a program stored in the storage unit 92. The program is installed to the control device 90 via various types of recording media, for example. Alternatively, the program may be installed via the Internet, for example.

The CPU 91 receives detection results from the respective sensors of the outdoor unit 2 via the sensor input unit 94. In addition, the CPU 91 receives a control signal from the indoor unit 3 via the communication unit 93. Based on the received detection result and control signal, the CPU 91 controls driving of the compressor 21, the outdoor fan 27, and the indoor fan 32. For example, the CPU 91 sets an instructed rotational frequency which is a rotational frequency for driving them. Moreover, the CPU 91 controls switching of the four way valve 22 on the basis of the received detection result and control signal. Furthermore, the CPU 91 adjusts the degree of opening of the expansion valve 24 on the basis of the received detection result and control signal.

[Operation of Refrigerant Circuit]

Next, flows of the refrigerant and operations of the respective parts in the refrigerant circuit 10 during an air conditioning operation of the air conditioner 1 in the present embodiment will be described with reference to FIG. 1.

(1. Cooling/Drying Operation)

In the case where the indoor unit 3 performs a cooling or drying operation, the CPU 91 switches the four way valve 22 to enter a state shown by the broken line as shown in FIG. 1. Specifically, the CPU 91 switches the four way valve 22 so that the port a and the port b are in communication with each other and the port c and the port d are in communication with each other. Accordingly, a cooling cycle in which the outdoor heat exchanger 23 functions as a condenser and the indoor heat exchanger 31 functions as an evaporator is provided.

The refrigerant discharged from the compressor 21 flows through the discharge pipe 61 and flows in the four way valve 22. Then, the refrigerant flows through the refrigerant pipe 62 from the four way valve 22 and flows in the outdoor heat exchanger 23. The refrigerant that has flowed in the outdoor heat exchanger 23 exchanges heat with the outside air taken in the outdoor unit 2 and is condensed by rotation of the outdoor fan 27.

The refrigerant that has flowed out from the outdoor heat exchanger 23 flows through the outdoor unit liquid pipe 63 and is reduced in pressure when passing through the expansion valve 24. The degree of opening of the expansion valve 24 during the cooling operation is adjusted so that the discharge temperature of the compressor 21 becomes a predetermined target temperature. The refrigerant that passed through the expansion valve 24 flows to the liquid pipe 4 via the stop valve 25. The refrigerant that has flowed through the liquid pipe 4 and flowed in the indoor unit 3 via the liquid pipe connection portion 33 flows through the indoor unit liquid pipe 67 and flows in the indoor heat exchanger 31.

The refrigerant that has flowed in the indoor heat exchanger 31 exchanges heat with the indoor air taken in the indoor unit 3 and is evaporated by rotation of the indoor fan 32. In this manner, the indoor heat exchanger 31 functions as an evaporator, and the indoor air cooled by heat exchange with the refrigerant in the indoor heat exchanger 31 is blown into the room through the air outlet (not shown). As a result, the room where the indoor unit 3 is installed is cooled.

The refrigerant that has flowed out from the indoor heat exchanger 31 flows through the indoor unit gas pipe 68 and flows to the gas pipe 5 via the gas pipe connection portion 34. The refrigerant that has flowed through the gas pipe 5 flows in the outdoor unit 2 via the stop valve 26. Then, the refrigerant flows through the outdoor unit gas pipe 64, the four way valve 22, the refrigerant pipe 69, the accumulator 28, and the suction pipe 66 in the stated order. Then, the refrigerant is sucked and re compressed by the compressor 21.

(2. Heating Operation)

In the case where the indoor unit 3 performs the heating operation, the CPU 91 switches the four way valve 22 to a state shown by the solid line as shown in FIG. 1. Specifically, the CPU 91 switches the four way valve 22 so that the port a and the port d are in communication with each other and the port b and the port c are in communication with each other. Accordingly, a heating cycle in which the outdoor heat exchanger 23 functions as an evaporator and the indoor heat exchanger 31 functions as a condenser is provided.

The refrigerant discharged from the compressor 21 flows through the discharge pipe 61 and flows in the four way valve 22. Then, the refrigerant flows through the outdoor unit gas pipe 64 from the four way valve 22 and flows in the gas pipe 5 via the stop valve 26. The refrigerant that has flowed through the gas pipe 5 flows in the indoor unit 3 via the gas pipe connection portion 34.

The refrigerant that has flowed in the indoor unit 3 flows through the indoor unit gas pipe 68, flows in the indoor heat exchanger 31, and exchanges heat with the indoor air taken in the indoor unit 3 and is condensed by rotation of the indoor fan 32. In this manner, the indoor heat exchanger 31 functions as a condenser, and the indoor air heated by heat exchange with the refrigerant in the indoor heat exchanger 31 is blown into the room through the air outlet (not shown). As a result, the room where the indoor unit 3 is installed is heated.

The refrigerant that has flowed out from the indoor heat exchanger 31 flows through the indoor unit liquid pipe 67 and flows in the liquid pipe 4 via the liquid pipe connection portion 33. The refrigerant that has flowed through the liquid pipe 4 and flowed in the outdoor unit 2 via the stop valve 25 flows through the outdoor unit liquid pipe 63 and is reduced in pressure when passing through the expansion valve 24. The degree of opening of the expansion valve 24 during the heating operation is adjusted so that the discharge temperature of the compressor 21 becomes a predetermined target temperature. The refrigerant that passed through the expansion valve 24 flows through the outdoor unit liquid pipe 63 and flows in the outdoor heat exchanger 23.

The refrigerant that has flowed in the outdoor heat exchanger 23 exchanges heat with the outside air taken in the outdoor unit 2 and is evaporated by rotation of the outdoor fan 27. The refrigerant that has flowed to the refrigerant pipe 62 from the outdoor heat exchanger 23 flows through the four way valve 22, the refrigerant pipe 69, the accumulator 28, and the suction pipe 66. Then, the refrigerant is sucked and re compressed by the compressor 21.

If the outside air temperature is low while the air conditioner 1 is performing the heating operation, frost is generated in the outdoor heat exchanger 23 that functions as an evaporator. If a large amount of frost is generated in the outdoor heat exchanger 23, it prevents heat exchange between the refrigerant and the outside air by the outdoor heat exchanger, which deteriorates the heat exchange capability in the outdoor heat exchanger 23. In view of this, in the case where the air conditioner 1 according to the present embodiment satisfies a defrosting start condition to be described later, the following reverse defrosting operation is performed.

(3. Defrosting Operation)

In the case where the outdoor unit 2 performs the defrosting operation, the CPU 91 switches the four way valve 22 to a state shown by the broken line as shown in FIG. 1, i.e., so that the port a and the port b of the four way valve 22 are in communication with each other and the port c and the port d are in communication with each other. Accordingly, in the refrigerant circuit 10, the outdoor heat exchanger 23 functions as a condenser and the indoor heat exchanger 31 functions as an evaporator. At this time, the expansion valve 24 is made fully open and the operations of the outdoor fan 27 and the indoor fan 32 are stopped.

The reverse defrosting operation is terminated when a constant time (e.g., 10 minutes) has elapsed or when the temperature of the outdoor heat exchanger 23 becomes a predetermined temperature (e.g., 10° C. or more), and the above mentioned heating operation is restarted.

[Operation Control of Outdoor Fan]

The outdoor fan 27 and the indoor fan 32 are each set to have a rotational frequency by which required cooling/drying operation or heating operation can be achieved during the above mentioned cooling/drying operation or heating operation. For example, during the cooling operation, the indoor fan 32 adjusts the amount of heat absorption of the refrigerant in the indoor heat exchanger 31 and blows the air cooled by heat exchange with the refrigerant flowing in the indoor heat exchanger 31 to the inside. Meanwhile, the outdoor fan 27 adjusts the amount of heat dissipation of the refrigerant in the outdoor heat exchanger 23 by controlling the rotational frequency depending on the outside air temperature.

Figure 3:
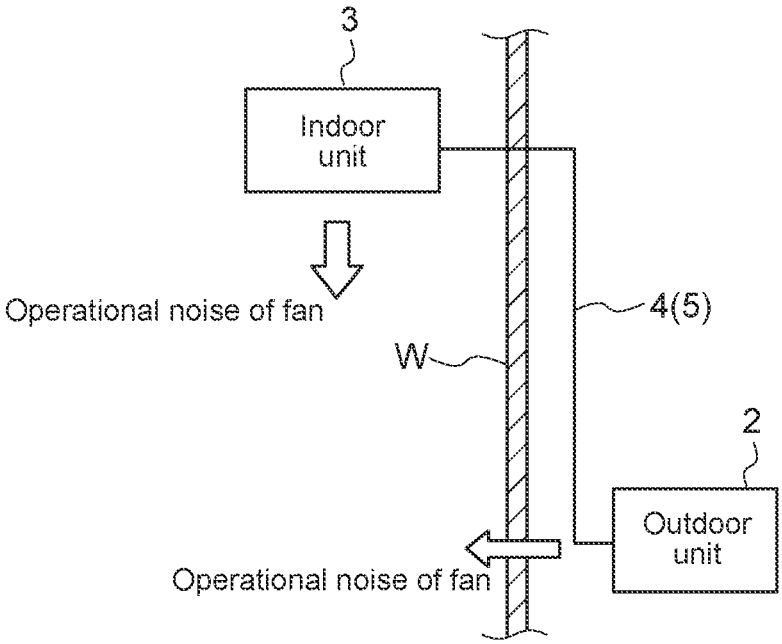
FIG. 3 A schematic view showing the air conditioner in which an outdoor unit as a heat source side unit is located outside the room and an indoor unit as a use side unit is located inside the room, sandwiching a building wall that partitions an indoor space and an outdoor space.

During the operation of the outdoor fan 27, operational noise such as wind noise is typically generated. For example, as shown in FIG. 3, with the air conditioner in which the outdoor unit 2 as the heat source side unit is placed outside the room and the indoor unit 3 as the use side unit is placed inside the room, sandwiching a building wall W that partitions an indoor space and an outdoor space, a user located in the room rarely notices operational noise of the outdoor fan 27. However, in the case where the outdoor environment is more silent than that in the daytime for example during a midnight operation, the user located in the room notices operational noise of the outdoor fan 27.

Figure 4:
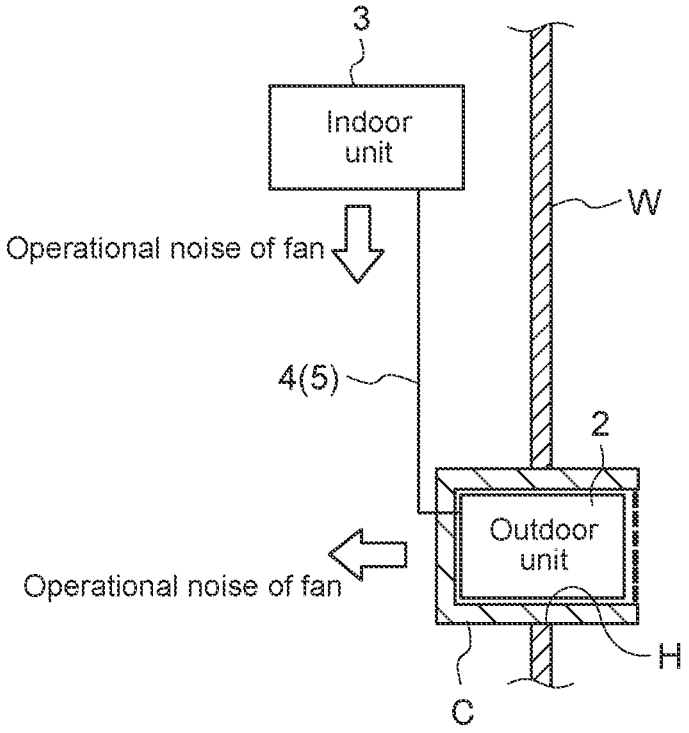
FIG. 4 A schematic view showing the air conditioner in which the outdoor unit as the heat source side unit is disposed in an external casing fitted in the opening penetrating the building wall that partitions the indoor space and the outdoor space.

Moreover, for example, as shown in FIG. 4, with the air conditioner in which the outdoor unit 2 as the heat source side unit is disposed in an external casing C fitted in an opening H penetrating the building wall W that partitions the indoor space and the outdoor space, operational noise of the indoor fan 32 is sometimes louder than operational noise of the outdoor fan 27. Therefore, with such an air conditioner, the user located in the room is likely to notice operational noise of the outdoor fan 27.

Therefore, depending on an operational environment of the air conditioner or a structure of the air conditioner, the user located in the room tends to consider operational noise of the outdoor fan 27 as loud noise for example during a high load operation. Therefore, the user located in the room may feel that it is unpleasant to the ears, for example. Thus, comfort and usability for the user located in the room may be impaired. In order to solve such a problem, the control device 90 according to the present embodiment is configured to perform the following processing on various operation modes.

In the present embodiment, the control device 90 sets an upper limit value of a rotational frequency of the outdoor fan 27 in accordance with a rotational frequency of the indoor fan 32. That is, although in the conventional air conditioner, the upper limit value of the rotational frequency of the outdoor fan is independently controlled irrespective of the rotational frequency of the indoor fan 32, in the present embodiment, the upper limit value of the rotational frequency of the outdoor fan 27 is limited in accordance with the rotational frequency of the indoor fan 32. Accordingly, operational noise of the outdoor fan 27 can be made unnoticeable to the user located in the room, and impairment of comfort and usability for the user located in the room is prevented.

Moreover, the upper limit value of the rotational frequency of the outdoor fan 27 is not limited to the case where it is set to a fixed value, and it may be changed in accordance with a change in rotational frequency of the indoor fan 32. For example, when the rotational frequency of the indoor fan 32 decreases by 10%, the rotational frequency of the outdoor fan 27 is also reduced by 10%. In this manner, when the rotational frequency of the indoor fan 32 decreases, the rotational frequency of the outdoor fan 27 may be reduced in accordance with a rate of decrease in rotational frequency of the indoor fan 32.

Accordingly, it is possible to ensure favorable exchange characteristics between the refrigerant and the outside air in the outdoor heat exchanger 23 and to prevent deterioration of comfort and usability for the user located in the room due to operational noise of the outdoor fan 27.

In addition, the air conditioner 1 according to the present embodiment has a plurality of operation modes, e.g., high (Hi), medium (Me), low (Lo), quiet (Qu), automatic (Auto), regarding the cooling/drying operation and the heating operation. Each of the operation modes may be selectively set by the user. On each of the operation modes such as high (Hi), medium (Me), low (Lo), and quiet (Qu), the indoor fan 32 constantly rotates at a preset rotational frequency for each operation mode. On the operation mode of automatic (Auto), the rotational frequency of the indoor fan 32 is controlled in accordance with a difference between a set temperature and a room temperature. The upper limit value of the rotational frequency of the outdoor fan 27 is set to be a rotational frequency judged to cause no problem for the usability by hearing in advance with respect to the upper limit value of the rotational frequency of the outdoor fan 27 for each operation mode. Accordingly, on any operation mode, the outdoor fan 27 can be operated with lower operational noise than that of the indoor fan 32.

Figures 5, 6:
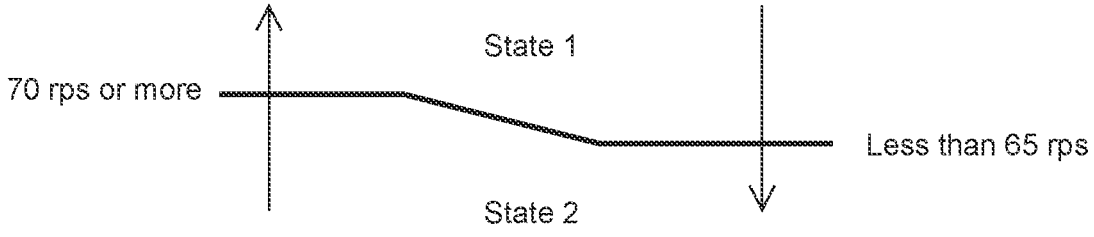
FIG. 5 A diagram showing an exemplary upper limit value of the rotational frequency of the outdoor fan on various operation modes regarding a cooling/drying operation and a heating operation.
FIG. 6 A conceptual diagram for describing switching of an operation state of a compressor.

As an example, FIG. 5 shows the upper limit value of the rotational frequency of the outdoor fan 27 on each of the operation modes with respect to the cooling/drying operation and the heating operation. On operation modes shown in the figure, the airflow rate increases in the order of "Qu", "Lo", "Me" and "Hi"/"Auto". Therefore, the upper limit value of the rotational frequency of the outdoor fan 27 on each operation mode is set to be equal to or lower than the upper limit value of the rotational frequency of the outdoor fan 27 on the operation mode on which the airflow rate is higher by at least one level. Moreover, the upper limit value of the rotational frequency of the compressor 21 is set in accordance with the rotational frequency of the indoor fan.

It should be noted that in FIG. 5, "State 1" and "State 2" are set as operation states of the compressor 21 during the heating operation. For example, in the case where a target rotational frequency of the compressor 21 at the time of the operation start is equal to higher than 70 rps, it is set to "State 1", and in the case where the target rotational frequency of the compressor 21 at the time of the operation start is lower than 70 rps, it is set to "State 2". Moreover, as shown in FIG. 6, when the rotational frequency of the compressor 21 that has started the operation becomes lower than, for example, 65 rps in "State 1", switching from "State 1" to "State 2" is performed, and when the rotational frequency of the compressor 21 that has started the operation becomes equal to or higher than 70 rps in "State 2", switching from "State 2" to "State 1" is performed.

In the example of FIG. 5, the upper limit value of the rotational frequency of the outdoor fan 27 in "State 1" of the heating operation is set to a value equal to or larger than the upper limit value of the rotational frequency of the outdoor fan 27 in "State 2" of the heating operation. In particular, in the case where the operation mode is "Hi" or "Auto", the upper limit value of the rotational frequency of the outdoor fan 27 is set to a value larger than that of "State 2". That is, in the case where the operation mode is "Hi" or "Auto", when the rotational frequency of the compressor 21 has changed from a predetermined first rotational frequency (in this example, 70 rps or more) into a predetermined second rotational frequency (in this example, less than 65 rps), the upper limit value of the rotational frequency of the outdoor fan 27 is changed from a first upper limit value (in this example, 1450 rpm) into a second upper limit value (in this example, 1360 rpm). The first and second rotational frequencies and the first and second upper limit values are not limited to those values and can be arbitrarily set in accordance with type, properties, etc. of the air conditioner 1.

Figure 7:
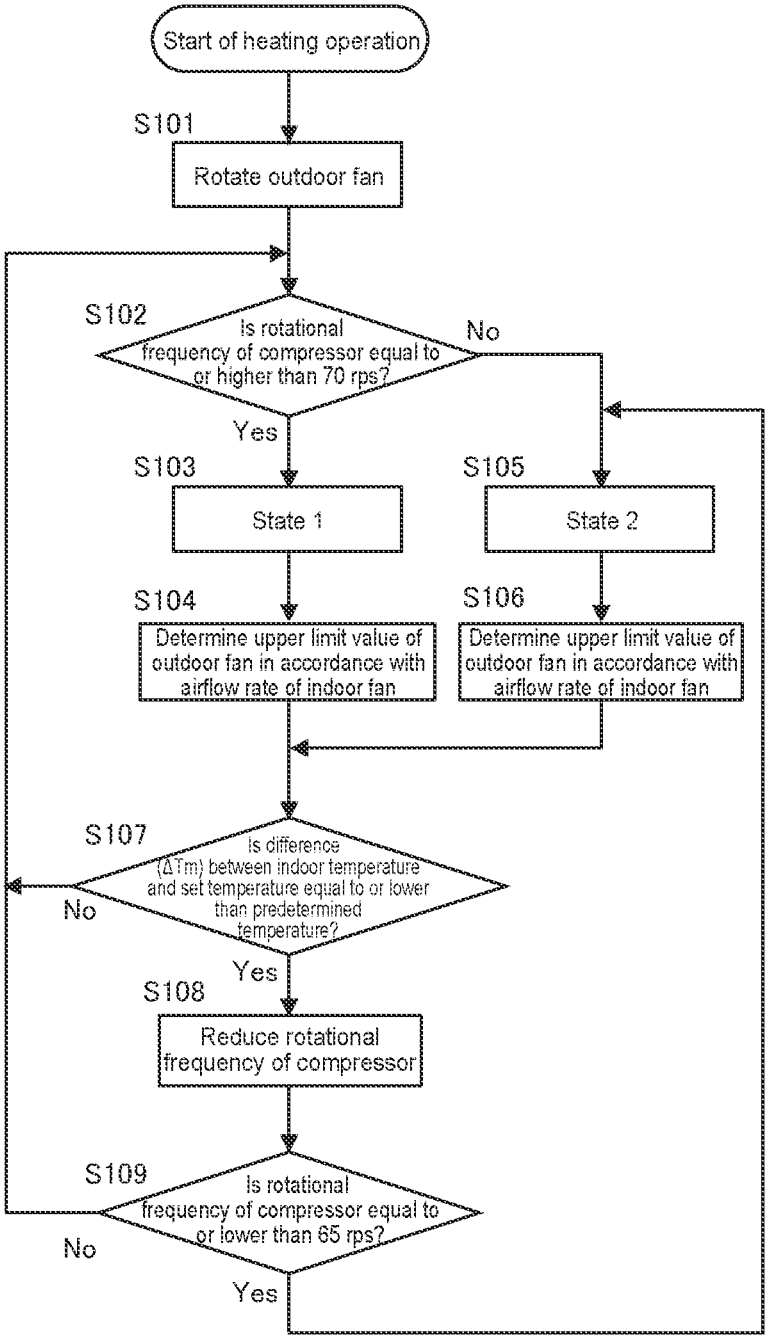
FIG. 7 A flowchart showing an exemplary processing procedure performed in the control device.
Figure 8:
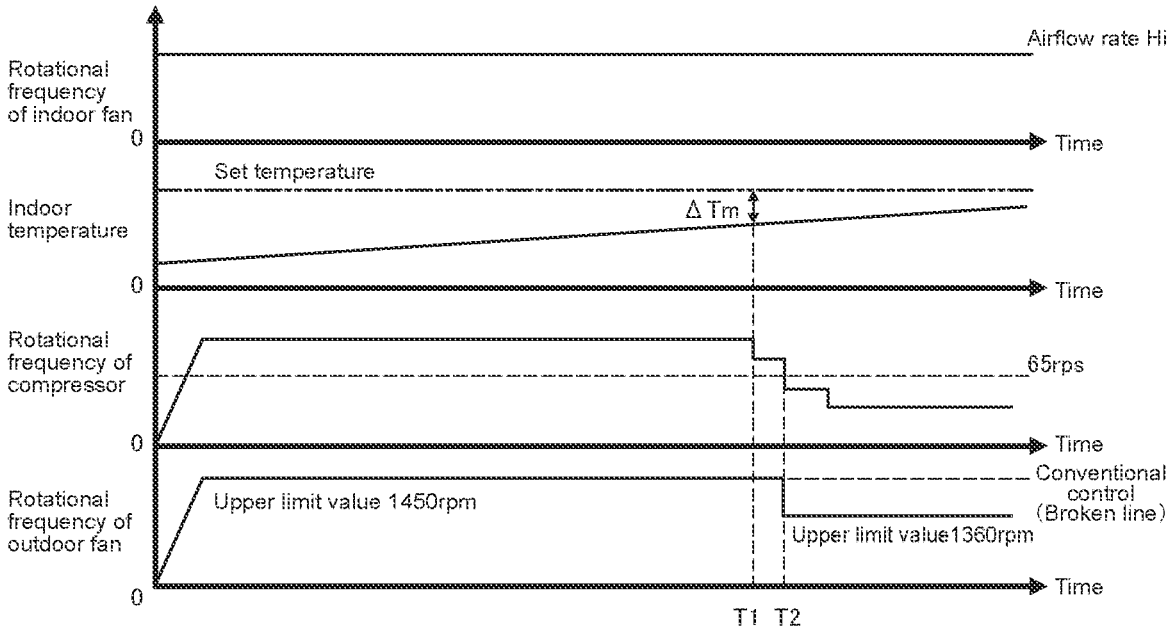
FIG. 8 A timing chart describing one action of the air conditioner.
Figure 9:
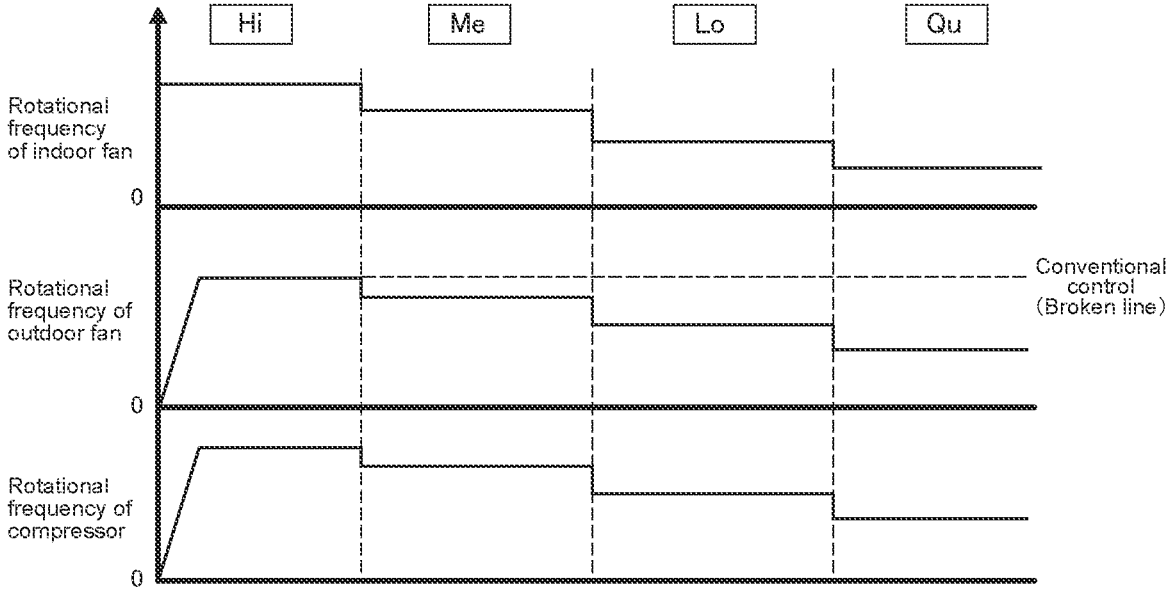
FIG. 9 A diagram of assistance in explaining exemplary rotational frequencies on various operation modes of an indoor fan, an outdoor fan, and a compressor in the air conditioner.

FIG. 7 is a flowchart showing an exemplary processing procedure performed in the CPU 91 of the control device 90. FIG. 8 is a timing chart describing one action of the air conditioner 1. FIG. 9 is a diagram of assistance in explaining exemplary rotational frequencies on the respective operation modes of the indoor fan 32, the outdoor fan 27, and the compressor 21. Hereinafter, details of the control on the rotational frequency of the outdoor fan 27 will be described also with reference to FIGS. 7 to 9, using the heating operation as an example.

When the heating operation is started, the control device 90 rotates the outdoor fan 27 together with the compressor 21 and the indoor fan 32 (Step 101 in FIG. 7). The compressor 21 starts the operation at a maximum rotational frequency set in accordance with the operation mode. For example, the rotational frequency of compressor 21 is 110 rps on the operation mode of "Hi", it is 74 rps on the operation mode of "Me", it is 63 rps on the operation mode of "Lo", and it is 58 rps on the operation mode of "Qu". As shown in FIG. 9, the rotational frequency corresponding to each of the operation modes is set as the rotational frequency of the indoor fan 32.

Subsequently, the control device 90 determines whether or not the rotational frequency of the compressor 21 is 70 rps or more (Step 102 in FIG. 7). In the present embodiment, as described above, the rotational frequency of the compressor 21 is 70 rps or more ("Yes" in Step 102) in the case where the operation mode is either "Hi" or "Me". Therefore, the upper limit value of the rotational frequency of the outdoor fan 27 is set in accordance with the airflow rate (rotational frequency) of the indoor fan 32 in such a range that it does not exceed the upper limit value of the rotational frequency in "State 1" of FIG. 5 (Step 103, 104). On the other hand, the rotational frequency of the compressor 21 is lower than 70 rps ("No" in Step 102) in the case where the operation mode is either "Lo" or "Qu", the upper limit value of the rotational frequency of the outdoor fan 27 is set in accordance with the airflow rate (rotational frequency) of the indoor fan 32 in such a range that it does not exceed the upper limit value of the rotational frequency in "State 2" of FIG. 5 (Step 105, 106).

Hereinafter, the case where the operation mode is "Hi" and the compressor 21 rotates in "State 1" will be described as an example. The upper limit value of the rotational frequency of the outdoor fan 27 is set to 1450 rpm (see FIG. 5).

The control device 90 determines whether or not a difference (ΔTm) between an indoor temperature and a set temperature is equal to or lower than a predetermined temperature (Step 107 in FIG. 7, Time T1 in FIG. 8). In the case where the indoor temperature reaches near the set temperature and the difference (ATm) between the indoor temperature and the set temperature becomes equal to or lower than the predetermined temperature ("Yes" in Step 107), the control device 90 performs control to gradually reduce the rotational frequency of the compressor 21 (Step 108). Such a predetermined temperature is not particularly limited, and for example, it is 5° C. or less. Moreover, in the control to gradually reduce the rotational frequency of the compressor 21, the rotational frequency of the compressor 21 is reduced by a predetermined amount. The predetermined amount is not particularly limited, and for example, it is 1 to several rps.

The control device 90 determines whether or not the rotational frequency of the compressor 21 after it is reduced by the predetermined amount is lower than 65 rps (Step 109 in FIG. 7). The rotational frequency of the compressor 21 returns to Step 102 in the case where it is equal to or higher than 65 rps ("No" in Step 109). In the case where ΔTm is equal to or lower than the predetermined temperature, the rotational frequency of the compressor 21 is further reduced by the predetermined amount (Step 107, 108). By gradually reducing the rotational frequency of the compressor 21 in this manner, the indoor temperature can be prevented from exceeding the set temperature.

In the case where the rotational frequency of the compressor 21 becomes lower than 65 rps ("Yes" in Step 109 in FIG. 7), the control device 90 switches the operation state of the compressor 21 from "State 1" to "State 2" and reduces the upper limit value of the rotational frequency of the outdoor fan 27 to 1360 rpm (see Step 105, 106, Time T2 in FIG. 8, FIG. 5).

As described above, by setting the rotational frequency of the indoor fan 32 in accordance with the upper limit value of the rotational frequency of the outdoor fan 27, operational noise of the outdoor fan 27 after the indoor temperature reaches near the set temperature decreases as compared to the conventional air conditioner in which the upper limit value of the rotational frequency of the outdoor fan 27 is fixed. Accordingly, deterioration of comfort or usability for the user located in the room can be prevented.

In addition, in the air conditioner according to the present embodiment, as shown in FIG. 9, the rotational frequency of the indoor fan 32 is set in accordance with the upper limit value of the rotational frequency of the outdoor fan 27 for each operation mode. Therefore, the user located in the room hardly notices operational noise of the outdoor fan 27, and impairment of comfort and usability for the user located in the room is prevented. In particular, in the case where the operation mode is "Me", "Lo", or "Qu", the upper limit value of the rotational frequency of the outdoor fan 27 can change in accordance with the rotational frequency of the indoor fan 32. Therefore, operational noise of the outdoor fan 27 on each of the operation modes can be reduced as compared to the conventional air conditioner in which the upper limit value of the rotational frequency of the outdoor fan is fixed (see FIG. 9). Accordingly, deterioration of comfort or usability for the user located in the room can be prevented.

Moreover, in accordance with the present embodiment, for example, also during an operation in the midnight time zone in which the outdoor environment is relatively silent or in the air conditioner (see FIG. 4) in which the outdoor unit 2 as the heat source side unit is disposed in the external casing C fitted in the opening Wa penetrating the building wall W that partitions the indoor space and the outdoor space, it is possible to prevent deterioration of comfort and usability for the user located in the room due to operational noise of the outdoor fan 27.

MODIFIED EXAMPLES

In the above mentioned embodiments, the air conditioner having the cooling and heating functions has been described as an example, though not limited thereto. For example, the present invention can also be applied to an air conditioner for cooling only.

REFERENCE SIGNS LIST

1 air conditioner
2 outdoor unit
3 indoor unit
10 refrigerant circuit
21 compressor
22 four way valve
23 indoor heat exchanger
24 expansion valve
27 outdoor fan

31 indoor heat exchanger
32 indoor fan
90 control device

The invention claimed is:

1. An air conditioner, comprising:

a refrigerant circuit including a compressor, an outdoor heat exchanger, an indoor heat exchanger, and an expansion valve that is disposed between the outdoor heat exchanger and the indoor heat exchanger;

an outdoor fan that blows air to the outdoor heat exchanger;

an indoor fan that blows air to the indoor heat exchanger; and a processor that reduces an upper limit value of a rotational frequency of the outdoor fan in accordance with a decrease in a rotational frequency of the indoor fan.

2. The air conditioner according to claim 1, further comprising an external casing fitted in an opening of a building wall that partitions an indoor space and an outdoor space, wherein the outdoor heat exchanger and the outdoor fan are disposed in the external casing.

3. The air conditioner according to claim 1, wherein the processor reduces, when the rotational frequency of the indoor fan decreases, the rotational frequency of the outdoor fan in accordance with a rate of decrease in the rotational frequency of the indoor fan.

4. The air conditioner according to claim 1, wherein the processor changes, when a rotational frequency of the compressor changes from a first rotational frequency into a second rotational frequency lower than the first rotational frequency, the upper limit value of the rotational frequency of the outdoor fan from a first upper limit value into a second upper limit value lower than the first upper limit value.

5. The air conditioner according to claim 1, wherein the air conditioner has a plurality of operation modes depending on a set airflow rate of the indoor fan, the processor sets the upper limit value of the rotational frequency of the outdoor fan in accordance with the plurality of operation modes, and the set upper limit value of the rotational frequency of the outdoor fan is equal to or lower than an upper limit value of the rotational frequency of the outdoor fan on an operation mode on which the airflow rate is higher by at least one level.

* * * * *